US005198852A

United States Patent [19]

Mikami

[11] Patent Number: 5,198,852

[45] Date of Patent: Mar. 30, 1993

[54] IMAGE FORMING APPARATUS

[75] Inventor: Tsutomu Mikami, Neyagawa, Japan

[73] Assignee: Matsushita Electric Industrial Co., Ltd., Kadoma, Japan

[21] Appl. No.: 840,836

[22] Filed: Feb. 25, 1992

[30] Foreign Application Priority Data

Mar. 1, 1991 [JP] Japan ..... 3-35877

[51] Int. Cl.[5] ..... G03G 5/00

[52] U.S. Cl. ..... 355/211; 355/246; 356/446

[58] Field of Search ..... 355/210, 211, 245, 246, 355/214; 356/446; 29/121.1, 121.5, 121.6

[56] References Cited

U.S. PATENT DOCUMENTS

| | | | |
|---|---|---|---|
| 4,162,126 | 7/1979 | Nakagawa et al. | 356/446 X |
| 4,313,671 | 2/1982 | Kuru | 355/246 X |
| 4,627,712 | 12/1986 | Usani | 355/246 X |
| 4,646,677 | 3/1987 | Lounsbury, Jr. et al. | 29/121.5 |
| 5,087,822 | 2/1992 | Fairlie et al. | 356/446 X |

FOREIGN PATENT DOCUMENTS

| | | |
|---|---|---|
| 56-164354 | 12/1981 | Japan . |
| 60-60665 | 4/1985 | Japan . |
| 2264984 | 10/1990 | Japan . |

*Primary Examiner*—A. T. Grimley
*Assistant Examiner*—Christopher Horgan
*Attorney, Agent, or Firm*—Ratner & Prestia

[57] ABSTRACT

An image forming apparatus having a pattern forming device for forming on a photosensitive member, a plurality of patterned images having toner attached thereto; a light emitting device for irradiating light over the patterned images on the photosensitive member; and a photosensor device for detecting toner density on the basis of quantity of the light scattered by the patterned images; wherein an incident plane of the light emitting device relative to the photosensitive member is parallel to a cutting direction of a tubular stock of the photosensitive member.

3 Claims, 6 Drawing Sheets $\theta_0 = \theta_1$ $\theta_o > \theta_2$

IMAGE FORMING APPARATUS

BACKGROUND OF THE INVENTION

The present invention relates to an image forming apparatus such as a facsimile machine, a digital copying apparatus or the like.

A known image forming apparatus includes a corona charger for uniformly charging a photosensitive surface of a photosensitive member, a latent image forming device for forming on the charged photosensitive surface, a latent image corresponding to recording data a developing device for developing the latent image into a visible image and a transfer device for transferring the visible image onto a recording paper sheet such that image formation is sequentially performed by displacing the photosensitive surface. At this time, quality of the image reproduced on the recording paper sheet largely depends on uniformity of charging of the photosensitive surface and stability of density of developer in the developing device. Thus, it is considered effective for improving quality of the reproduced image to monitor density of developer.

FIG. 1 shows one example of the known image forming apparatus. The known image forming apparatus includes a semiconductor laser 11, a rotary polygon mirror 12, an f$\theta$ lens 13, a second mirror 14, a first mirror 15, a cleaner 16, a corona charger 17, a photosensitive member 18, a color developing device 19, a photosensor 110, a light emitting element 111, a toner density detecting circuit 113, a pattern generator 114, a reader 116 for reading an original document, a laser modulation circuit 117, a toner density detecting means 91, a controller 92, a control circuit 93 for controlling laser current and a control circuit 94 for controlling developing bias. The toner density detecting means 91 includes the photosensor 110, the light emitting element 111 and the toner density detecting circuit 113. In FIG. 1, reference numeral 115 denotes a normal relative to an outer peripheral surface of the photosensitive member 18.

Operation of the known image forming apparatus of the above described arrangement is described with reference to FIGS. 2 to 4. Initially, a control signal f outputted from the controller 92 is inputted to the pattern generator 114. Thus, a pattern signal i is produced in the pattern generator 114 so as to be outputted to the control circuit 93. Meanwhile, a laser current setting signal k for setting laser current is preliminarily applied to the control circuit 93 from the controller 92. In response to the laser current setting signal k from the controller 92, the control circuit 93 determines a value of current for driving the semiconductor laser 11. The control circuit 93 outputs, in turn, a laser current controlling signal 1 and a pattern signal j to the laser modulation circuit 117. In response to the laser current controlling signal 1 and the pattern signal j, the laser modulation circuit 117 produces a modulation signal e for modulating the semiconductor laser 11 and outputs the modulation signal e to the semiconductor laser 11 such that the semiconductor laser 11 is modulated by the modulation signal e.

Meanwhile, the photosensitive member 18 is preliminarily charged by the corona charger 17 uniformly. In response to the modulation signal e from the laser modulation circuit 117, a plurality of patterned latent images are formed on the photosensitive member 18 by the semiconductor laser 11. Then, a control signal h for controlling developing bias is outputted to the control circuit 94 from the controller 92. In response to the control signal h from the controller 9&, the control circuit 94 outputs developing bias voltage signals m, n, o and p to the color developing device 19 such that the patterned latent images formed on the photosensitive member 18 are sequentially developed, through adhesion of toner thereto, into visible patterned images 101 (FIG. 2) by the color developing device 19 as will be described in detail later. Toner density of the visible patterned images 101 is detected by the toner density detecting means 91.

In response to a light emitting signal b from the toner density; detecting circuit 113, the light emitting element 111 irradiates light over the visible patterned images 101 at an incident angle $\theta_0$ relative to the normal 115 as shown in FIG. 3. The irradiated light is reflected by toner particles 22 (FIG. 3) of the visible patterned images 101 such that this reflected light is detected at an angle $\theta_1$ of reflection relative to the normal 115 by the photosensor 110. At this time, in order to detect direct reflected light from the photosensitive member 18, the incident angle $\theta_0$ is so set as to be identical with the angle $\theta_1$ of reflection, i.e. $\theta_0=\theta_1$. A quantity a of direct reflected light detected by the photosensor 110 is transmitted to the toner density detecting circuit 113 and thus, the toner density detecting circuit 113 outputs a detection signal c to the controller 92. In the controller 92, the detection signal c is compared with a preset reference value and the laser current setting signal k is calculated so as to obtain optimum density characteristics. The controller 92 outputs the laser current setting signal k to the control circuit 93 so as to optimize a value of current for driving the semiconductor laser 11.

Since the control signal h for optimizing the developing bias voltage signals m, n, o and p applied to the color developing device 19 is outputted to the control circuit 94 from the controller 92 as described above, it is possible to control voltages applied to the color developing device 19. Thus, by employing at least one of the laser current controlling means (control circuit 93) and the developing bias controlling means (control circuit 94), density correction for each color can be performed.

After completion of density correction, the visible patterned images 101 are removed from the photosensitive member 18 by the cleaner 16. In accordance with an image signal g applied to the controller 92 from the reader 116, the modulation signal e is produced by the laser modulation circuit 117 and an image of the original document subjected to density correction is outputted through developing, transfer and fixing steps in a known electrophotographic process.

FIG. 2 shows the visible patterned images 101 formed on the photosensitive member 18[In response to the modulation signal e from the laser modulation circuit 117, the visible patterned images 101 are formed through rotation of the photosensitive member 18 in the direction of the arrow A such that amount of toner adhering to each of the visible patterned images 101 increases gradually as the photosensitive member 18 is further rotated in the direction of the arrow A.

FIG. 3 shows the known toner density detecting means 91. In FIG. 3, an optical axis 26 of the light emitting element 111 forms the angle $\theta_0$ with the normal 115 on the outer peripheral surface of the photosensitive member 18, while an optical axis 27 of the photosensor 110 forms the angle $\theta_1$ with the normal 115 on the outer peripheral surface of the photosensitive member 18. The light emitting element 111 irradiates light over the toner particles 22 of the visible patterned images 101, which adhere to the photosensitive member 18. Irradiated light from the light emitting element 111 is reflected by the photosensitive member 18. At this time, quantity of reflected light changes according to amount of the toner particles 22 adhering to the photosensitive member 18. As the amount of the toner particles 22 adhering to the photosensitive member 18 is increased, quantity of light reflected by the photosensitive member 18 decreases. This reflected light is received by the photosensor 110 set at the angle $\theta_1$ relative to the normal 115. The angles $\theta_0$ and $\theta_1$ of the light emitting element 111 and the photosensor 110 are, respectively, so set as to be equal to latch other such that detection of direct reflected light on the photosensitive member 18 is facilitated.

FIG. 4 shows output characteristics of the photosensor 110 in the toner density detecting means 91. It will be seen from FIG. 4 that output voltage of the photosensor 110 assumes 3.9 V when the toner particles 22 do not adhere to the photosensitive member 18. Meanwhile, output voltage of the photosensor 110 decreases as amount of the toner particles 22 adhering to the photosensitive member 18 is increased. Since output voltage of the photosensor 110 assumes 3.5 V when a maximum amount of the toner particles 22 adhere to the photosensitive member 18, dynamic range of output voltage of the photosensor 110 is 0.4 V.

However, in the above described known arrangement, since toner density is read from reflected light on the photosensitive member 18, dynamic range of output voltage of the photosensor 110 is small and signal-to-noise ratio is poor, so that it is impossible to accurately control density gradation of an outputted image.

SUMMARY OF THE INVENTION

Accordingly, an essential object of the present invention is to provide, with a view to eliminating the disadvantages inherent in conventional image forming apparatuses, an image forming apparatus in which toner density corresponding to a predetermined pattern on a photosensitive member can be detected highly accurately.

In order to accomplish this object of the present invention, an image forming apparatus comprising: a pattern forming means for forming on a photosensitive member, a plurality of patterned images having toner attached thereto; a light emitting means for irradiating light over the patterned images on said photosensitive member; and a photosensor means for detecting toner density on the basis of quantity of the light scattered by the patterned images; wherein an incident plane of said light emitting means relative to said photosensitive member is parallel to a cutting direction of a tubular stock of said photosensitive member.

By the above described arrangement of the present invention, toner density can be detected accurately in the image forming apparatus having a simple construction, so that an outputted image can be kept at an excellent density gradation at all times.

BRIEF DESCRIPTION OF THE DRAWINGS

This object and features of the present invention will become apparent from the following description taken in conjunction with the preferred embodiment thereof with reference to the accompanying drawings in which.

Before the description of the present invention proceeds, it is to be noted that like parts are designated by like reference numerals throughout several views of the accompanying drawings.

DETAILED DESCRIPTION OF THE INVENTION

Figure 5:
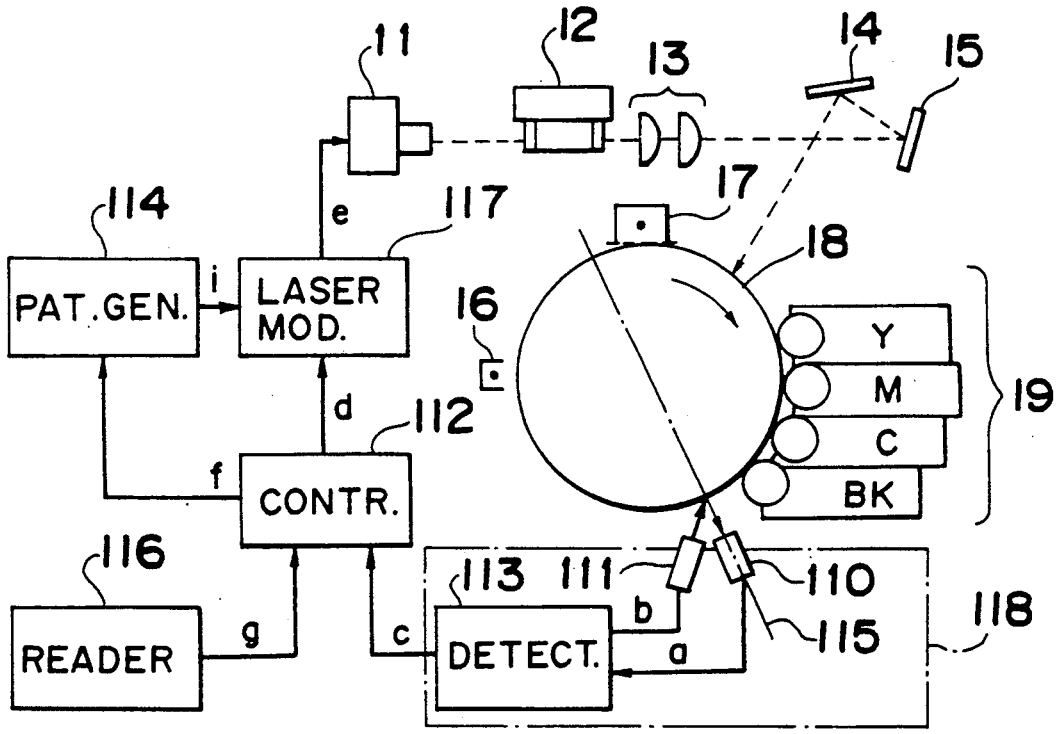
FIG. 5 is a schematic view of an image forming apparatus according to the present invention.

Referring now to the drawings, there is shown in FIG. 5, an image forming apparatus according to the present invention. The image forming apparatus includes a semiconductor laser 11, a rotary polygon mirror 12, an f$\theta$ lens 13, a second mirror 14, a first mirror 15, a cleaner 16, a corona charger 17, a photosensitive member 18, a color developing device 19, a photosensor 10, a light emitting element 111, an image density control means 112 for controlling density of an image, a toner density detecting circuit 113, a pattern generator 114, a read]r 116 for reading an original document, a laser modulation circuit 117 and a toner density detecting means 118. The toner density detecting means 118 includes the photosensor 110, the light emitting element 111 and the toner density detecting circuit 113. In FIG. 5, reference numeral 115 denotes a normal relative to an outer peripheral surface of the photosensitive member 18.

Figure 1:
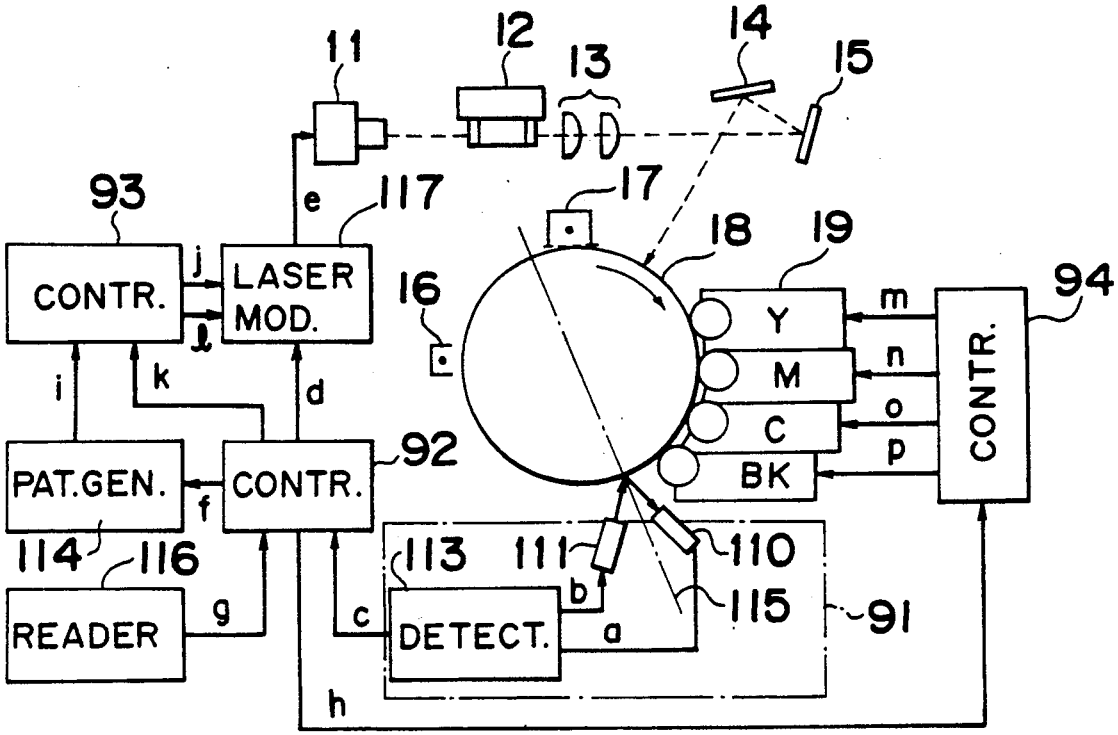
Fig. 1 PRIOR ART
FIG. 1 is a schematic view of a prior art image forming apparatus (already referred to)
Figure 2:
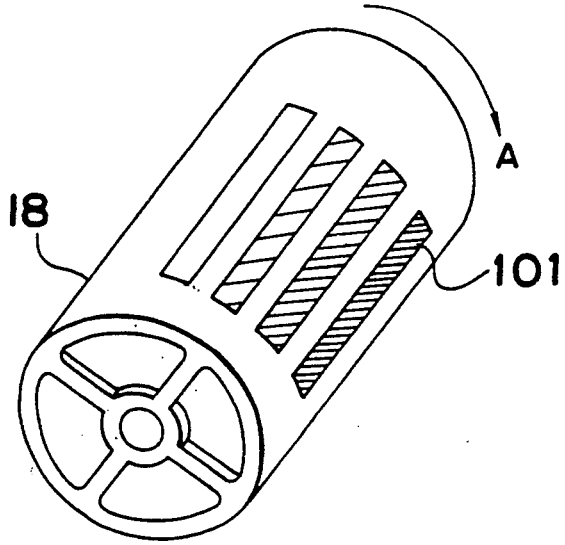
Fig. 2 PRIOR ART
FIG. 2 is a perspective view of patterns formed on a photosensitive member employed in the prior art image forming apparatus of FIG. 1 (already referred to)
Figure 3:
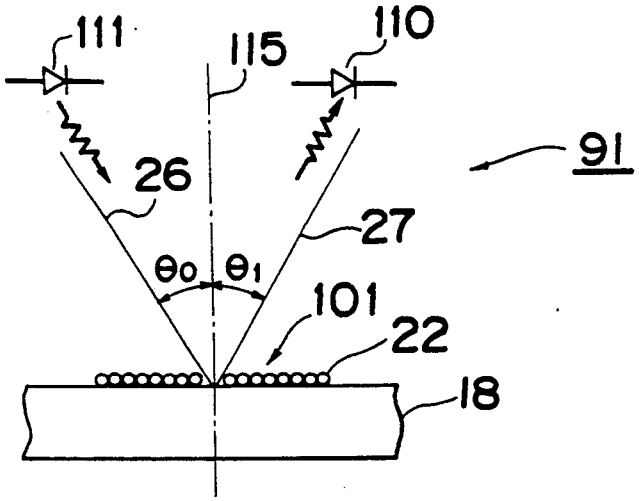
Fig. 3 PRIOR ART
FIG. 3 is a schematic view of a toner density detecting means employed in the prior art image forming apparatus of FIG. 1 (already referred to)
Figure 4:
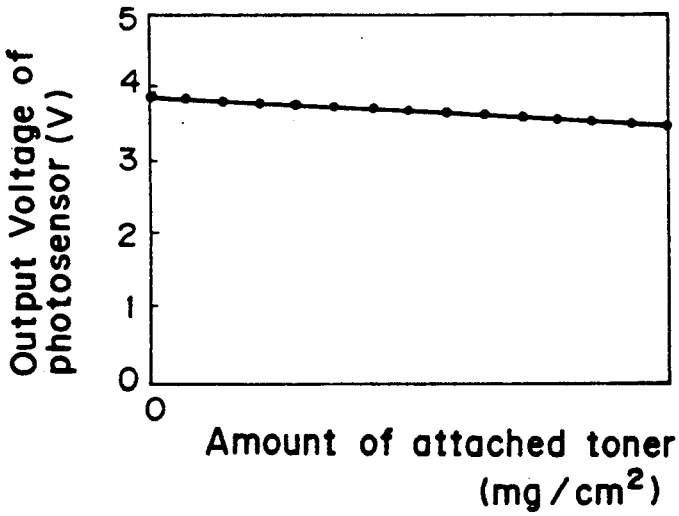
Fig. 4 PRIOR ART
FIG. 4 is a graph showing output characteristics of a photosensor of the toner density, detecting means of FIG. 3 (already referred to)

Operation of the image forming apparatus of the above described arrangement is descried with reference to FIGS. 5 to 12. Initially, a control signal f outputted from the image density control means 112 is inputted to the pattern generator 114. Thus, a pattern signal i is produced in the pattern generator 114 so as to be outputted to the laser modulation circuit 117. In response to the pattern signal i from the pattern generator 114, the laser modulator 117 produces a modulation signal e for modulating the laser modulator 11. Hence, the laser modulator 11 is modulated by the modulation signal e such that a plurality of patterned latent images are formed on the photosensitive member 18. In the same manner as a prior art image forming apparatus, the patterned latent images formed on the photosensitive member 18 are sequentially developed[through adhesion of toner thereto, into visible patterned images 101 by the color developing device 19 as shown in FIG. 2. The visible patterned images 101 are detected by the toner density detecting means 118.

Figure 6:
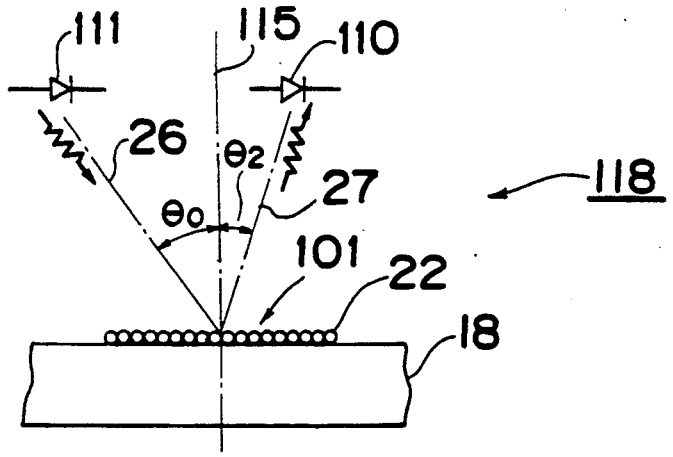
FIG. 6 is a schematic view of a toner density detecting means employed in the image forming apparatus of FIG. 5.

As shown in FIGS. 6 and the light emitting element 111 irradiates light over toner particles 22 of the visible patterned images 101 at an incident angle $\theta_0$ relative to the normal 115 such that an incident plane in which the incident angle $\theta_0$ is formed is parallel to a cutting direction 47 (direction of hairlines) of a tubular stock of the photosensitive member 18. Then, reflected light on the visible patterned images 101 are detected at an angle $\theta_2$ of reflection relative to the normal 115 by the photosensor 110. At this time, in order to detect reflected light scattered by the visible patterned images 101, the angle $\theta_0$ is so set as to be larger than the angle $\theta_2$, i.e. $\theta_0 > \theta_2$. In this embodiment, the angle $\theta_0$ is set at 45°, while the angle $\theta_2$ is set at 0° such that the photosensor 110 is oriented in the direction of the norma 115 as shown in FIG. 5. Amount of toner adhering to the photosensitive member 18 is detected by the light emitting element 111 and the photosensor 110 and a detection signal is transmitted from the toner density detecting circuit 113 to the image density control means 112. The toner density detecting means 118 will be described in detail later.

In the image density control means 112, the detection signal c is compared with a preset reference value so as to detect state of development. By comparing the detection signal c with the preset reference value, the image density control means 112 performs density correction for each color such that optimum density characteristics are obtained. The image density control means 112 will be described in detail later. After completion of density correction, the visible patterned images 101 are removed from the photosensitive member 18 by the cleaner 18. Then, in accordance with an information signal g outputted from the reader 116 to the image density control means 112, a modulation signal e for modulating the semiconductor laser 11 is produced by the laser modulation circuit 117 and an image of the original document is outputted through developing, transfer and fixing steps in a known electrophotographic process.

FIG. 6 shows the toner density detecting means 118. In FIG. 6, an optical axis 26 of the light emitting element 111 forms the angle $\theta_0$ with the normal 115 on the outer peripheral surface of the photosensitive member 18, while an optical axis 27 of the photosensor 110 forms the angle $\theta_2$ with the normal 115 on the outer peripheral surface of the photosensitive member 18. The light emitting element 111 irradiates light over the toner particles 22 of the visible patterned images 101 adhering to the photosensitive member 18. This light irradiated by the light emitting element 111 is reflected by the toner particles 22. Light reflected by the toner particles 22 is received by the photosensor 110. Since the angle $\theta_0$ is so set as to be larger than the angle $\theta_2$ as described above, light of total reflection is not detected by the photosensor 110 and light scattered by the toner particles 22 is detected by the photosensor 110.

Figure 7:
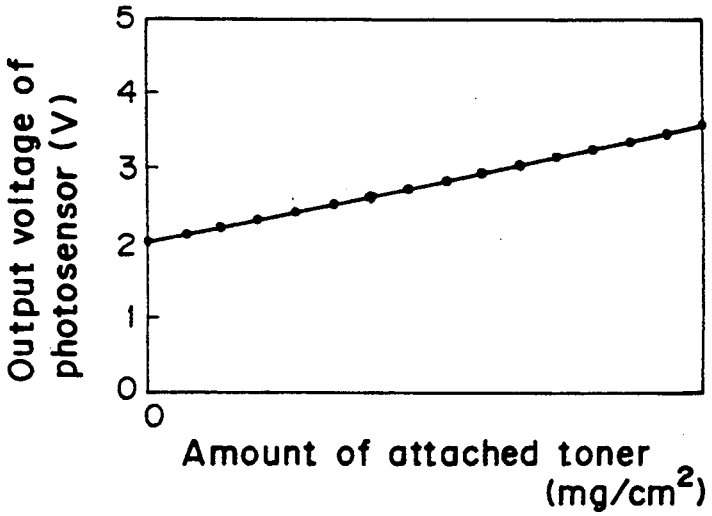
FIG. 7 is a graph showing output characteristics of a photosensor of the toner density detecting means of FIG. 6.

FIG. 7 shows output characteristics of the photosensor 110 of the toner density detecting means 118. In FIG. 7, the abscissa represents amount of toner adhering to the photosensitive member 18 and the ordinate represents output voltage of the photosensor 110. It is understood from FIG. 7 that output voltage of the photosensor 110 changes linearly relative to amount of toner adhering to the photosensitive member 18.

Figure 8:
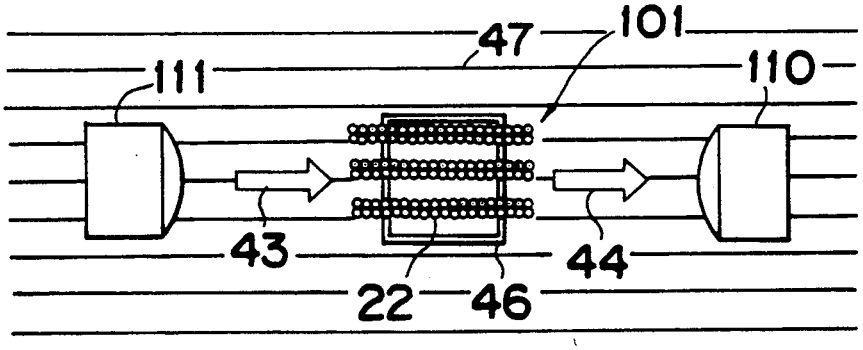
FIGS. 8 is a view showing an arrangement of hairlines of a tubular stock of a photosensitive member, a light emitting element and the photosensor employed in the image forming apparatus of FIG. 5.

FIG. 8 shows an arrangement of hairlines of the tubular stock of the photosensitive member 18, the light emitting element 111 and the photosensor 110. The arrow 43 depicts a direction of an optical axis of the light emitting element 111, while the arrow 44 depicts a direction of an optical axis of the photosensor 110. In order to detect density of the toner particles 22 adhering to a detection area 46 of the photosensitive member 18, light is irradiated in the direction 43 of the optical axis of the light emitting element 111 by the light emitting element 111 and is scattered by the toner particles 22. At this time, since the direction 47 of the hairlines of the tubular stock of the photosensitive member 18 is parallel to the incident plane extending in the direction 43 of the optical axis of the light emitting element 111, scattered light due to the hairlines is not generated, so that only scattered light due to the toner particles 22 is incident upon the photosensor 110 in the direction 44 of the optical axis of the photosensor 110. As ratio of area of the toner particles 22 to that of the detection area 46 is raised, scattered light due to the toner particles 22 increases.

Figure 9:
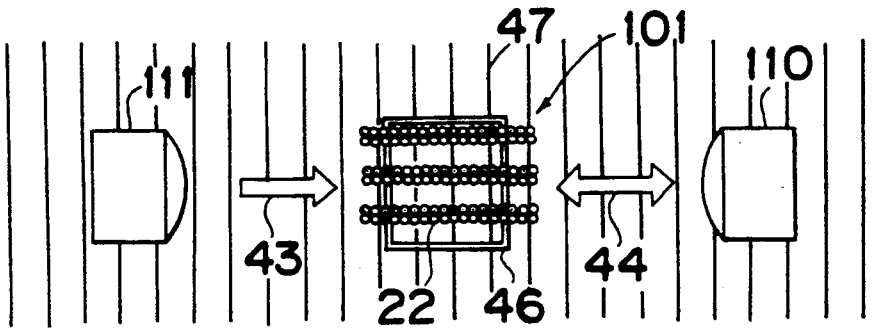
FIG. 9 is a view showing a comparative example of the arrangement of FIG. 8.

FIG. 9 shows a comparative example of the arrangement of FIG. 8. In order to detect density of the toner particles 22 adhering to the detection area 46 of the photosensitive member 18, light is irradiated in the direction 43 of the optical axis of the light emitting element 111 by the light emitting element 111 so as to generate scattered light due to the hairlines The scattered light is incident upon the photosensor 110 in the direction 44 of the optical axis of the photosensor 110. At this time, since the direction 47 of the hairlines is perpendicular to the incident plane extending in the direction 43 of the light emitting element 111, scattered light due to the hairlines is incident upon the photosensor 110 in the direction 44 of the optical axis of t photosensor 110. As ratio of area of the toner particles 22 to that of the detection area 46 is raised, scattered light due to the hairlines decreases.

Figure 10:
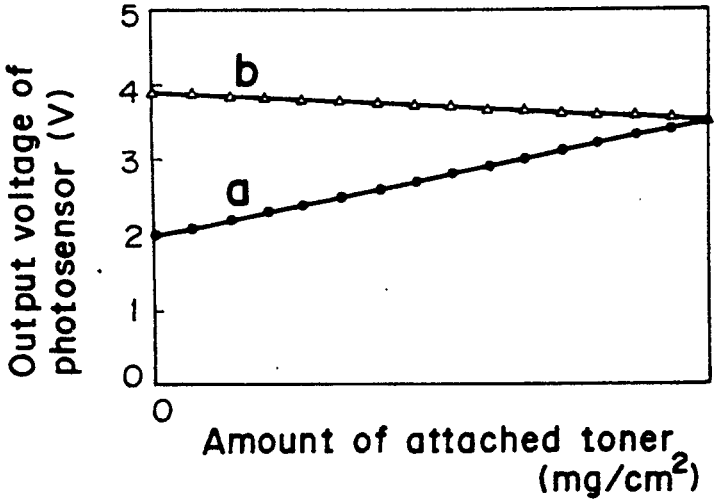
FIG. 10 is a graph showing output characteristics of the photosensor of FIG. 6 in the arrangements of FIGS. 8 and 9.

FIG. 10 shows output characteristics of the photosensor 110 of the toner density detecting means 118. The curve a represents the arrangement of FIG. 8, while the curve b represents the arrangement of FIG. 9. In the curve a, output voltage of the photosensor 110 is 2 V and 3.5 V when amount of the toner particles 22 adhering to the detection area 46 is zero and a maximum, respectively. Thus, dynamic range of output voltage of the photosensor 110 is 1.5 V (=3.5−2).

On the other hand, in the curve b, output voltage of the photosensor 110 is 3.8 V and 3.5 V when amount of the toner particles 22 adhering to the detection area 46 is zero and a maximum, respectively. Hence, dynamic range of output voltage of the photosensor 110 is mere 0.3 V (=3.8−3.5) undesirably. Therefore, dynamic range of output voltage of the photosensor 111 changes according to the direction 47 of the hairlines and the direction 43 of the optical axis of the light emitting element 111. Since dynamic range of the arrangement of FIG. 8 is far superior to that of the arrangement of FIG. 9 as described above, the arrangement of FIG. 8 is employed in this embodiment.

Figure 11:
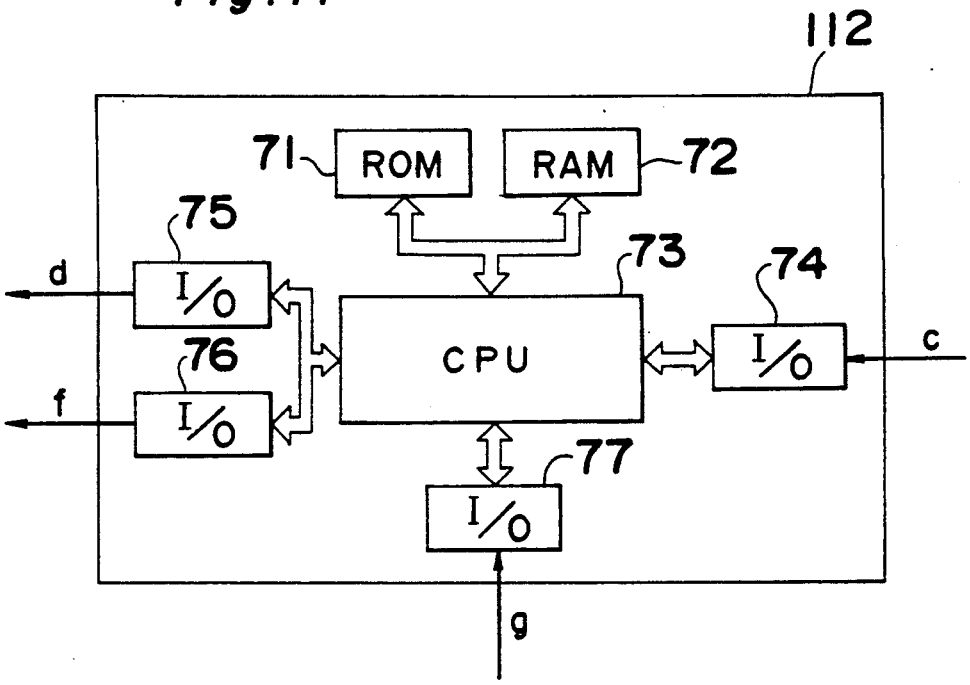
FIG. 11 is a block diagram showing a structure of an image density control means employed in the image forming apparatus of FIG. 5.

FIG. 11 shows a structure of the image density control means 112. The image density control means 112 includes a read-only memory (ROM) 71, a random access memory (RAM) 72, a central processing unit (CPU) 73 and input/output (I/0) ports 74 to 77. The detection signal c indicative of toner density is sequentially inputted to the CPU 73 through the I/0 port 74. The detection signal c inputted to the CPU 73 is sequentially recorded in the RAM 72 in accordance with algorithm stored in the ROM 71. The CPU 73 compares the detection signal c recorded in the RAM 72 with a preset reference value of the ROM 71 so as to calculate a corrected value. The corrected value calculated by the CPU 73 is recorded, as a $\gamma$ corrected value, in the RAM 72. Based on the $\gamma$ corrected valve recorded in the RAM 72, the CPU 73 performs $\gamma$ correction for the image signal g inputted to the CPU 73 via the I/0 port 77 so as to output an image correction signal d via the I/O port 75.

Figure 12:
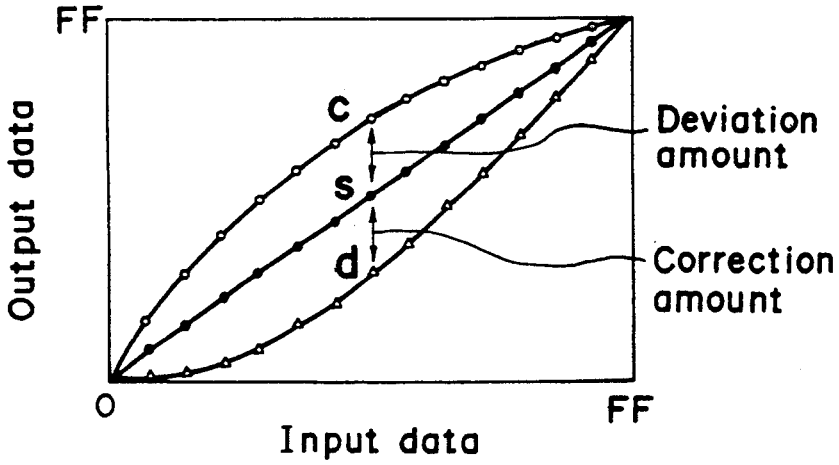
FIG. 12 is a view showing data in a RAM of the density control means of FIG. 11.

FIG. 12 shows data in the RAM 72 of the image density control means 112. In FIG. 12, the abscissa represents the image signal g acting as input data, while the ordinate represents the image correction signal d acting as output data. The curve c illustrates measured value of toner density. The curve s illustrates preset reference value, while the curve d illustrates value corrected based on the preset reference value s. The corrected value d is calculated by, for example, the following equation (1).

$$d=2\times s-c \quad (1)$$

In the present invention, since toner density can be detected highly accurately by the simple structure of the image forming apparatus, the obtained image can be kept at an excellent density gradation at all times.

As is clear from the foregoing description, toner density is detected by quantity of light scattered by the visible patterned images on the photosensitive member and the incident plane of the light emitting element relative to the photosensitive member is parallel to the cutting direction of the tubular stock of the photosensitive member in the toner density detecting means of the present invention.

Therefore, in accordance with the present invention, since toner density is accurately detected by the toner density detecting means without the need for using a sensor means having a complicated structure such that image data is corrected, a high-quality image having excellent gradation characteristics can be obtained stably at low cost.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. An image forming apparatus comprising:

a pattern forming means for forming on a photosensitive member, a plurality of patterned images having toner attached thereto;

a light emitting means for irradiating light over the patterned images on said photosensitive member; and a photosensor means for detecting toner density on the basis of quantity of the light scattered by the patterned images;

wherein an incident plane of said light emitting means relative to said photosensitive member is parallel to a cutting direction of a tubular stock of said photosensitive member.

2. An image forming apparatus as claimed in claim 1, further comprising a control means which corrects image data in accordance with a value detected by said photosensor means so as to control density of an image.

3. An image forming apparatus as claimed in claim 24, wherein said control means includes a read-only memory, a random access memory and a control processing unit.

* * * * *

UNITED STATES PATENT AND TRADEMARK OFFICE

CERTIFICATE OF CORRECTION

PATENT NO. : 5,198,852

DATED : March 30, 1993

INVENTOR(S) : Tsutomu Mikami

It is certified that error appears in the above-indentified patent and that said Letters Patent is hereby corrected as shown below:

Column 8, line 37, claim 3, delete "24" and insert --2--.

Column 8, line 39, claim 3, delete "control" and insert --central --.

Signed and Sealed this

Eighteenth Day of January, 1994

*Attest:*

Bruce Lehman

BRUCE LEHMAN

*Attesting Officer*

*Commissioner of Patents and Trademarks*